US008319414B2

(12) United States Patent
Date

(10) Patent No.: US 8,319,414 B2
(45) Date of Patent: Nov. 27, 2012

(54) IMAGE DISPLAY APPARATUS WITH LOW-POTENTIAL ELECTRODE SET

(75) Inventor: Takashi Date, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/575,664

(22) Filed: Oct. 8, 2009

(65) Prior Publication Data

US 2010/0090580 A1 Apr. 15, 2010

(30) Foreign Application Priority Data

Oct. 9, 2008 (JP) ..... 2008-262994

(51) Int. Cl.
*H01J 1/62* (2006.01)
*H01J 63/04* (2006.01)

(52) U.S. Cl. ..... 313/496; 313/495; 313/336; 313/351

(58) Field of Classification Search ..... 313/495–497, 313/309–311, 336, 351, 346 R
See application file for complete search history.

(56) References Cited

U.S. PATENT DOCUMENTS

| | | | | |
|---|---|---|---|---|
| 6,803,717 | B2 * | 10/2004 | Ohnishi | 313/495 |
| 6,998,769 | B2 * | 2/2006 | Ohnishi | 313/495 |
| 7,554,256 | B2 * | 6/2009 | Onishi | 313/496 |
| 2002/0047661 | A1 * | 4/2002 | Yamazaki et al. | 315/366 |
| 2005/0046332 | A1 * | 3/2005 | Tajima et al. | 313/495 |
| 2006/0049744 | A1 * | 3/2006 | Ando | 313/496 |
| 2006/0061258 | A1 | 3/2006 | Tagawa | |
| 2007/0164674 | A1 * | 7/2007 | Hori | 313/512 |
| 2008/0111466 | A1 * | 5/2008 | Cho et al. | 313/495 |

FOREIGN PATENT DOCUMENTS

| | | | |
|---|---|---|---|
| EP | 1638129 | A2 | 3/2006 |
| JP | 2006-120622 | A | 5/2006 |

* cited by examiner

*Primary Examiner* — Anh Mai
*Assistant Examiner* — Kevin Quarterman
(74) *Attorney, Agent, or Firm* — Canon U.S.A., Inc. IP Division

(57) ABSTRACT

An image display apparatus includes a face plate including a low-potential electrode and a plate-like spacer including a longitudinal-direction end. The low-potential electrode is set at a lower potential than that of a resistive anode and is disposed between the resistive anode and a feed electrode. The longitudinal-direction end of the plate-like spacer is disposed between the resistive anode and the feed electrode so as to overlap the low-potential electrode.

6 Claims, 6 Drawing Sheets

IMAGE DISPLAY APPARATUS WITH LOW-POTENTIAL ELECTRODE SET

BACKGROUND OF THE INVENTION

1. Field of the Invention

The present invention relates to an image display apparatus using an electron beam, such as a field emission display (FED).

2. Description of the Related Art

For a display apparatus that displays an image by emitting electrons from an electron-emitting device to a light-emitting member, it is desired to cause sufficiently accelerated electrons to strike the light-emitting member in order to improve luminance. Thus, it is necessary to apply a high voltage to an anode. However, with a recent reduction in thickness of a display apparatus, discharge may occur between the electron-emitting device on the rear plate and the anode on the face plate.

A known measure to address such discharge is the use of a resistive anode in a display apparatus. Japanese Patent Laid-Open No. 2006-120622 discloses a configuration in which a resistive anode and a power supply are connected with a plurality of feed electrodes connected to two mutually opposing sides of the anode.

Unfortunately, in the configuration described in the above patent document, because the anode is fed from the plurality of feed electrodes disposed around the anode, power supplies corresponding to the number of feed electrodes are necessary, so the configuration is inevitably complicated.

SUMMARY OF THE INVENTION

The present invention provides a new image display apparatus that can reduce the occurrence of discharge more reliably without using a complex configuration.

According to an aspect of the present invention, an image display apparatus includes a rear plate, a face plate, and a plate-like spacer. The rear plate includes an electron-emitting device. The face plate includes a resistive anode and a feed electrode. The feed electrode is disposed outside of the resistive anode so as to surround the resistive anode and electrically connect the resistive anode and a power supply. The face plate faces the rear plate such that the resistive anode faces the electron-emitting device. The plate-like spacer is disposed between the rear plate and the face plate. The plate-like spacer has a longitudinal-direction end disposed outside of the resistive anode so as to lie across the resistive anode. The face plate further includes a low-potential electrode set at a lower potential than that of the resistive anode. The low-potential electrode is disposed between the resistive anode and the feed electrode. The longitudinal-direction end of the plate-like spacer is disposed between the resistive anode and the feed electrode so as to overlap the low-potential electrode.

With the present invention, a satisfactory image is obtainable without the use of a complex configuration. In particular, the occurrence of discharge at a spacer edge, at which discharge is apt to occur, can be reliably reduced. Additionally, the occurrence of discharge at a feed electrode portion, at which discharge can possibly occur on a large scale, can be reliably reduced.

Further features of the present invention will become apparent from the following description of exemplary embodiments with reference to the attached drawings.

DESCRIPTION OF THE EMBODIMENTS

Embodiments of the present invention are described below with reference to the accompanying drawings.

Figure 1:
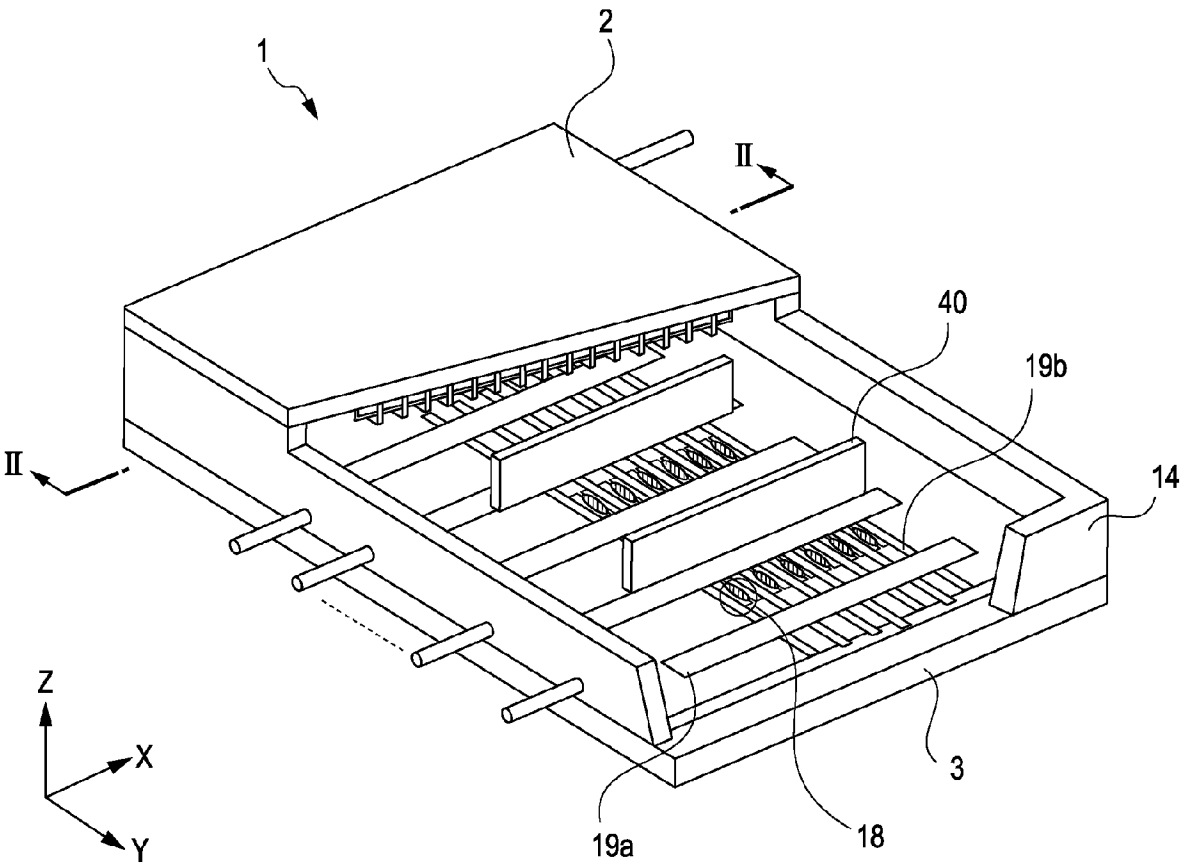
FIG. 1 is a cutaway perspective view that illustrates in general an image display apparatus according to an embodiment of the present invention.
Figure 2:
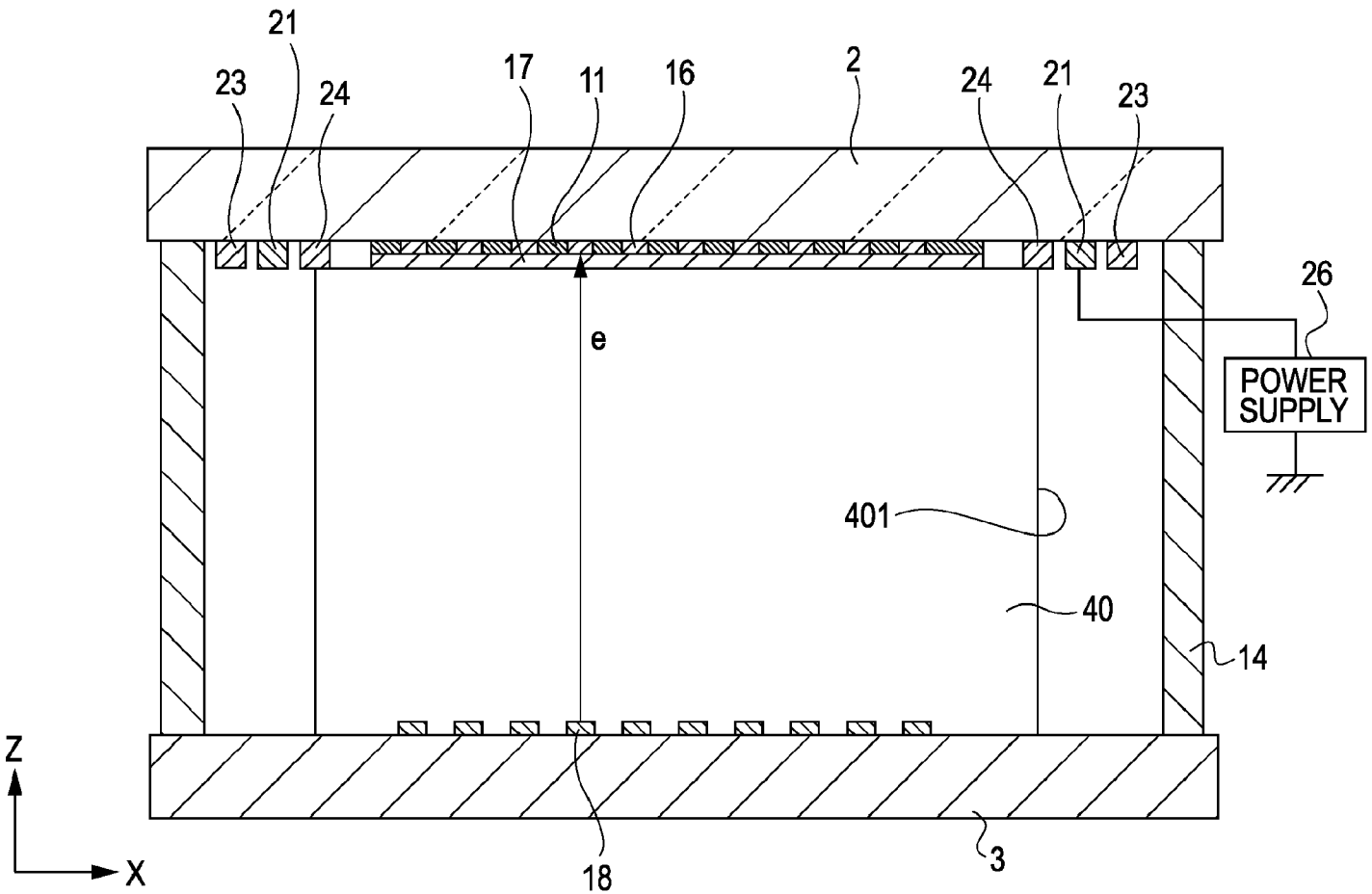
FIG. 2 is a partial cross-sectional view of FIG. 1.
Figure 3A:
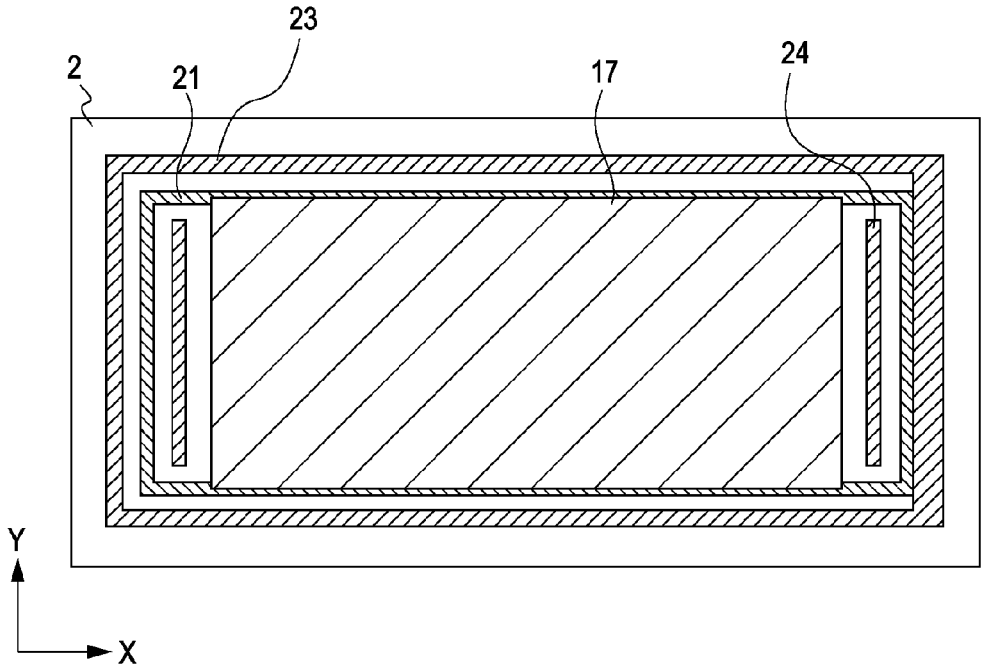
FIGS. 3A and 3B are plan views that illustrate an example of a face plate and that of a rear plate, respectively, according to an embodiment of the present invention.
Figure 3B:
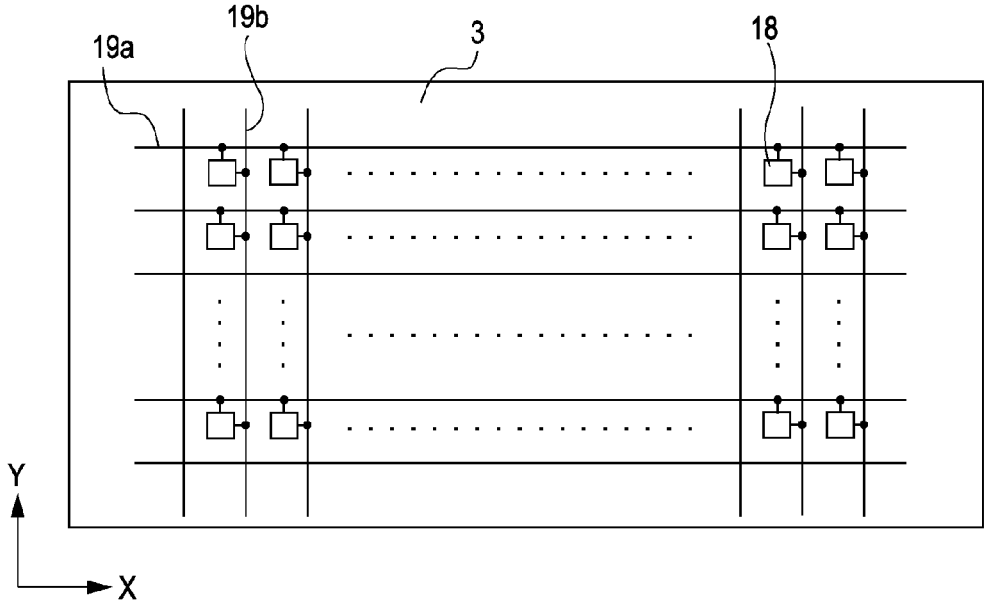

FIG. 1 illustrates in general an image display apparatus 1 according to an embodiment of the present invention and is a cutaway perspective view of the image display apparatus 1 to show an internal configuration. FIG. 2 is a cross-sectional view taken along the line II-II of FIG. 1. FIG. 3A illustrates a face plate 2 included in the image display apparatus 1 seen from a rear plate 3. FIG. 3B illustrates the rear plate 3 seen from the face plate 2. The image display apparatus 1 includes a resistive anode 17 and a feed electrode 21 on the surface of the face plate 2. The feed electrode 21 is disposed outside the resistive anode 17 so as to surround the resistive anode 17. The feed electrode 21 is connected to an external power supply 26. The power supply 26 is electrically connected to the resistive anode 17 through the feed electrode 21. The image display apparatus 1 further includes an electrode 24 on the surface of the face plate 2 between the resistive anode 17 and the feed electrode 21. The electrode 24 has a potential set at lower than that of the resistive anode 17. Hereinafter, the electrode 24 is also referred to as the low-potential electrode 24 or the first low-potential electrode 24. In the present embodiment, as illustrated in FIG. 3A, the resistive anode 17 is connected to the feed electrode 21, which surrounds the resistive anode 17, at two sides.

The image display apparatus 1 includes one or more electron-emitting devices 18 on the rear plate 3. In the present embodiment, as illustrated in FIG. 3B, a plurality of electron-emitting devices 18 are present. The plurality of electron-emitting devices 18 are connected to one another in a matrix form using scanning wiring 19*a* and information wiring 19*b*.

A plate-like spacer 40 lying across the resistive anode 17 is arranged between the rear plate 3 and the face plate 2. The plate-like spacer 40 has an end 401 in a longitudinal direction located outside the resistive anode 17. Hereinafter, the end 401 is also referred to as the longitudinal-direction end 401. The longitudinal-direction end 401 of the plate-like spacer 40 indicates an end in an X-axis direction illustrated in FIG. 2.

In the present embodiment, as illustrated in FIGS. 2 and 3A, the feed electrode 21 is disposed so as to surround the resistive anode 17. Accordingly, even with a small number of power supplies 26 (e.g., a single power supply), power can be fed at a plurality of locations of the resistive anode 17 (two locations in FIG. 3A). This can reduce a voltage drop in the anode occurring when electrons emitted from the electron-emitting device flow through the anode. Accordingly, even with a single power supply, unevenness of light emission luminance of a displayed image can be reduced. The use of the plate-like spacer 40, which lies across the resistive anode 17, can reduce the number of spacers. Therefore, complication of the image display apparatus can be avoided.

The plate-like spacer 40 lying across the resistive anode 17 raises the possibility that the plate-like spacer 40 may cross the feed electrode 21 or, although the plate-like spacer 40 does not cross the feed electrode 21, the longitudinal-direction end 401 of the plate-like spacer 40 may overlap the feed electrode 21. This is described below using FIGS. 4A and 4B.

Figure 4A:
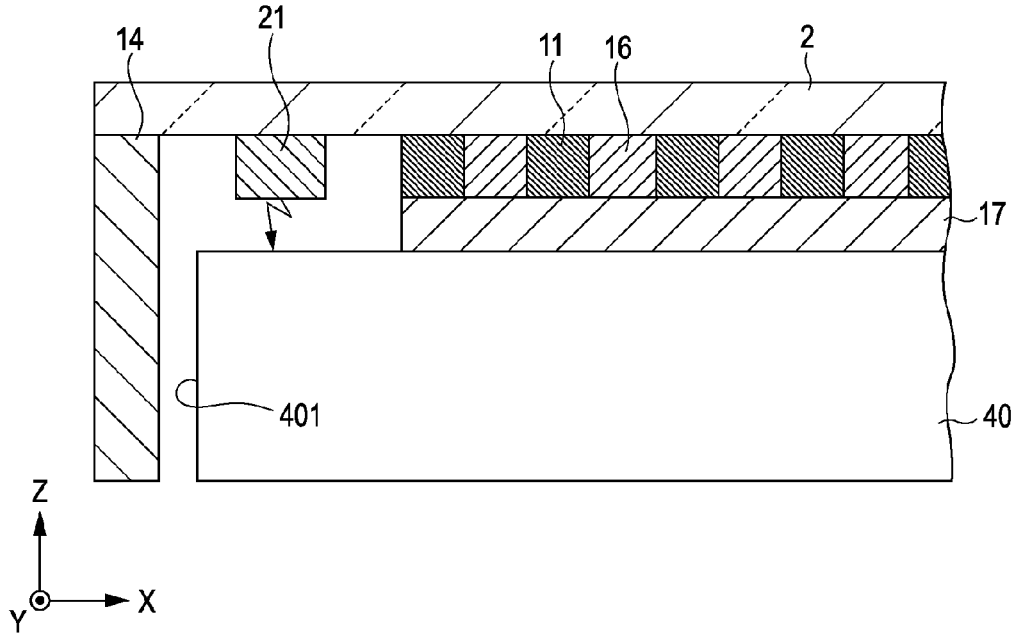
FIGS. 4A and 4B illustrate cases where an edge of a plate-like spacer in a longitudinal direction and a feed electrode overlap each other.
Figure 4B:
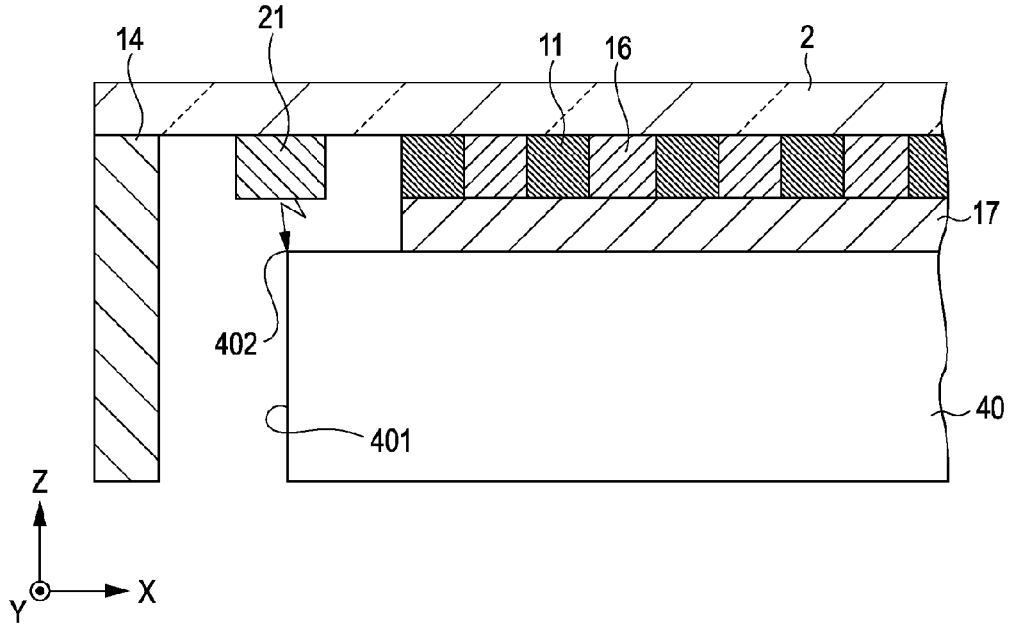

FIGS. 4A and 4B illustrate examples of an image display apparatus that does not adopt the present invention and partial enlarged cross-sectional views each illustrating a positional relationship between the face plate and the spacer. In FIGS. 4A and 4B, the same reference numerals are used for parts having the same structures as in FIG. 2. FIG. 4A illustrates a case where the plate-like spacer 40 crosses the feed electrode 21; FIG. 4B illustrates a case where the longitudinal-direction end 401 of the plate-like spacer 40 overlaps the feed electrode 21. In either case, when the plate-like spacer 40 and the feed electrode 21 are spaced away from each other with a small gap, as illustrated, discharge may occur between the plate-like spacer 40 and the feed electrode 21. In particular, as illustrated in FIG. 4B, when the longitudinal-direction end 401 of the plate-like spacer 40 overlaps the feed electrode 21 and a small gap is present therebetween, because the longitudinal-direction end 401 has a protrusion 402 formed by a plurality of surfaces (a surface facing the face plate (XY plane in the drawing), an end face in the longitudinal direction (YZ plane in the drawing), and a side face (XZ plane in the drawing) of the spacer), an electric field tends to concentrate, so discharge is particularly apt to occur. In addition, the feed electrode 21 cannot be subjected to current limiting, because the feed electrode 21 is an electrode, so occurring discharge is inevitably large.

In contrast, as illustrated in FIG. 2, the low-potential electrode 24, which is set at a lower potential than that of the anode, is disposed between the resistive anode 17 and the feed electrode 21, and the plate-like spacer 40 is located such that the longitudinal-direction end 401 overlaps the low-potential electrode 24. Accordingly, the longitudinal-direction end 401, on which an electric field is apt to concentrate, can be within a low potential region, so the occurrence of discharge between the end of the plate-like spacer 40 and any one of the elements on the face plate to which a high voltage is applied (the resistive anode 17 and the feed electrode 21) can be reliably reduced. In particular, if discharge occurs between the feed electrode 21 and the plate-like spacer 40, the discharge tends to be large because the feed electrode 21 has no resistance component that limits current. In contrast, as in the present embodiment, when the feed electrode 21, which leads to large-scale discharge, is arranged outside the low-potential electrode 24, a high potential region caused by the feed electrode 21 can be positioned outside a low potential region. Accordingly, the occurrence of discharge between the feed electrode 21 and the plate-like spacer 40 can be reliably reduced.

Elements in the present embodiment are described below.

As the face plate 2, a member that allows visible light to pass therethrough, such as glass, can be used. In present embodiment, a high anti-strain glass, such as PD200, can be suitably used.

Figure 6A:
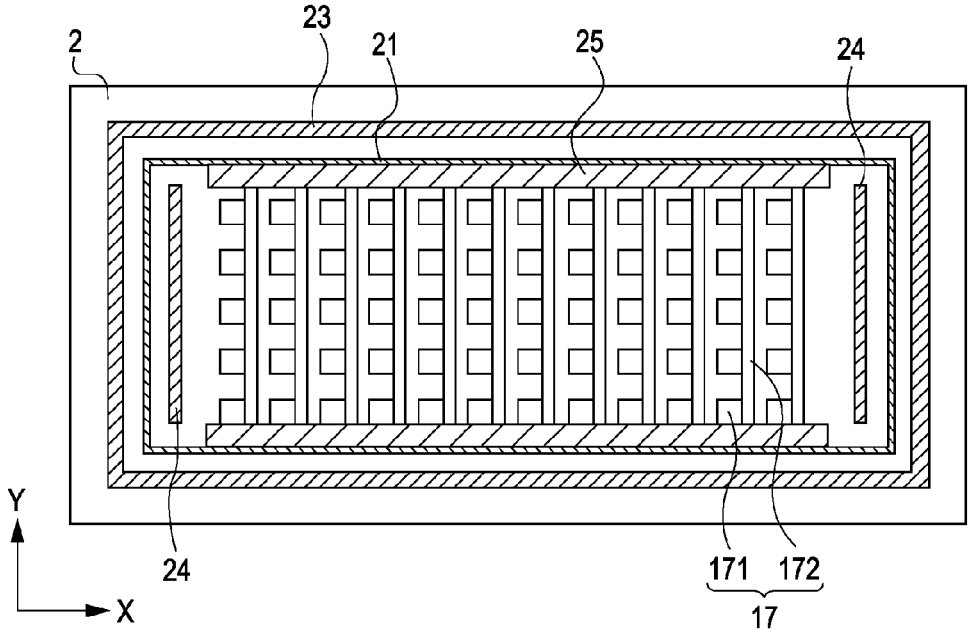
FIGS. 6A and 6B are plan views that illustrate other examples of a face plate according to an embodiment of the present invention.
Figure 6B:
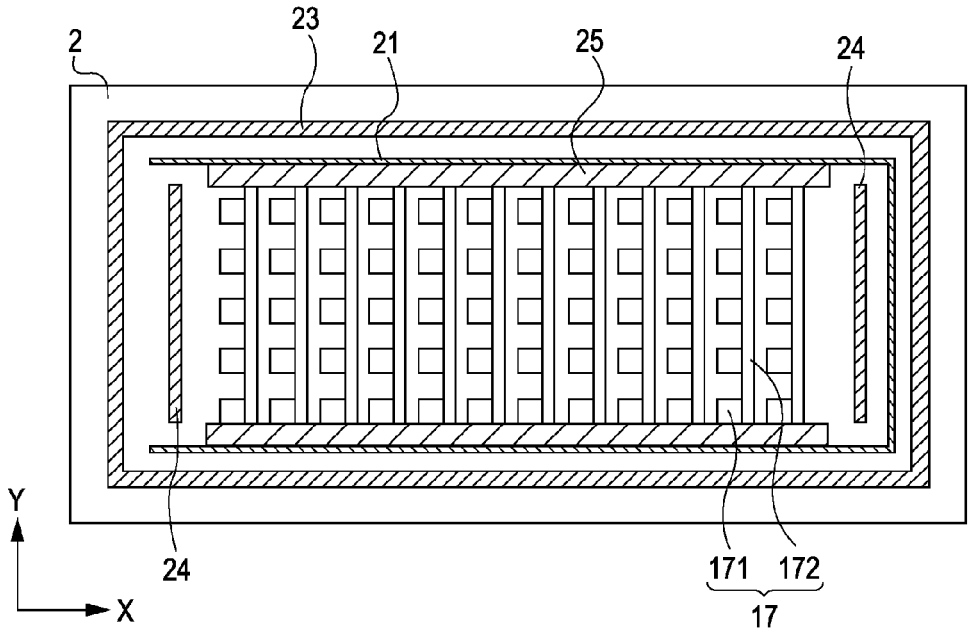

As the resistive anode 17, a resistor made of, for example, indium tin oxide (ITO) can be used. It is useful that the resistance of the resistive anode 17 between adjacent light-emitting members be 1 kΩ to 1 kΩ. Although this resistance depends on the number of pixels of a display apparatus, when compared with the resistance of the feed electrode 21, which is described below, the resistance of the resistive anode 17 per unit length is greater than that of the feed electrode 21 per unit length by a factor of at least 1000. As illustrated in FIGS. 6A and 6B, the resistive anode 17 may include a plurality of conductive members 171 arranged in a matrix form and a resistor 172 connecting adjacent conductive members. In this case, when metal-backed conductive members made of aluminum, which are known in cathode ray tubes (CRTs), are used and they are connected by the resistor 172, the discharge current can be suppressed by use of the resistor 172 while luminance is improved effectively utilizing light emission of a light-emitting member 16. Because it is necessary to make electrons pass through the conductive members 171 and reach the light-emitting member 16, the thickness of each of the conductive members 171 is set in consideration of loss of energy of electrons, a set acceleration voltage, and light reflection efficiency. When the output voltage of the power supply 26 is in the range between 5 kV and 15 kV, the thickness of the conductive member 171 is set in the range of approximately 50 nm to 300 nm.

The light-emitting member 16 and a light-shielding member 11 are disposed between the resistive anode 17 and the face plate 2. As the light-emitting member 16, fluorescent crystal emitting light by electron beam excitation can be used. Specific examples of the fluorescent member include fluorescent materials used in traditional CRTs described in, for example, Phosphor Research Society, "Keikotai handobukku," Ohmsha Ltd. (Japan), whose English version revised edition is "Phosphor Handbook," CRC Press, USA. The thickness of the fluorescent member is set in consideration of an acceleration voltage, the particle diameter of the fluorescent member, the packing density of the fluorescent member, and other factors. When the acceleration voltage is in the range of approximately 5 kV to 15 kV, the thickness of the fluorescent member is set in the range of approximately 4.5 μm to 30 μm, which are 1.5 to 3 times larger than the mean particle diameters 3 μm to 10 μm of a typical fluorescent member. It is useful that the thickness of the fluorescent member be set in the range of approximately 5 μm to 15 μm. As the light-shielding member 11, a black matrix structure publicly known in CRTs can be used. Typically, the light-shielding member 11 can be made of a black metal, a black metallic oxide, or carbon. Examples of the black metallic oxide include ruthenium oxide, chromium oxide, iron oxide, nickel oxide, molybdenum oxide, cobalt oxide, and copper oxide. When ITO is used as the resistive anode, as described above, the light-emitting member 16 and the light-shielding member 11 may be formed on the anode.

The feed electrode 21 can be made of any material as long as it is a conductive material, such as metal. In order to reduce a voltage drop of the feed electrode 21 itself when a high voltage is supplied from the power supply 26, it is useful that the resistance between the feed electrode 21 and a section farthest from the connection with the power supply 26 be set at 1 kΩ or less.

It is useful that the low-potential electrode 24, which is set at a lower potential than that of the resistive anode 17, be set at the GND potential. In the present embodiment, the image display apparatus 1 further includes a second electrode 23 set at a low potential disposed outside the feed electrode 21. Hereinafter, the second electrode 23 is also referred to as the second low-potential electrode 23. The configuration including the second low-potential electrode 23 is useful in that a side wall 14 can be in a low potential region and the occurrence of discharge between the side wall 14 and the feed electrode 21 can also be reduced.

To further suppress a discharge current, as illustrated in FIGS. 6A and 6B, a connection resistor 25 may be disposed between the feed electrode 21 and the resistive anode 17. In this case, the resistance of the connection resistor 25 can be set in the range of approximately 0.1 to 10 MΩ.

Next, the rear plate 3 is described. As illustrated in FIGS. 2 and 3B, the plurality of electron-emitting devices 18 for liberating electrons used in causing the light-emitting member 16 to emit light by excitation are disposed on the inner surface of the rear plate 3. As the electron-emitting devices 18, surface-conduction electron emitting devices can be suitably used, for example. The plurality of scanning wiring segments 19*a* and the plurality of information wiring segments 19*b* for providing each of the electron-emitting devices 18 with a driving voltage are also disposed on the inner surface of the rear plate 3.

The plate-like spacer 40 can be composed of an insulator, such as glass, or a member in which a conductive material is mixed in an insulator. The surface of the plate-like spacer 40 may be covered with a resistive member. This case, where the spacer has slight conductivity, is useful in that charging in the spacer can be reduced.

In such a way, the image display apparatus 1 is formed such that the plate-like spacer 40 is arranged between the face plate 2 and the rear plate 3, and the outer portions of the face plate 2 and the rear plate 3 are coupled together with the side wall 14 disposed therebetween.

To display an image on the image display apparatus 1 having the above-described configuration, a voltage is applied to the resistive anode 17 through the feed electrode 21, a driving voltage is supplied to the electron-emitting devices 18 through the scanning wiring 19*a* and the information wiring 19*b*, and an electron beam is emitted from a desired electron-emitting device 18. The electron beam emitted from the electron-emitting device is accelerated and strikes the light-emitting member 16. The light-emitting member 16 is selectively excited and emits light. In this way, an image is displayed.

The feed electrode 21 fully surrounding the resistive anode 17, as illustrated in FIGS. 3A and 6A, may have another configuration. For example, as illustrated in FIG. 6B, the feed electrode 21 may surround three sides of the resistive anode 17. In this case, the limitations in layout of other elements can be reduced. In this case, the low-potential electrodes 24 and 23 are not necessarily required in a section at which the feed electrode 21 is not formed (the left end in the drawing).

Figure 5A:
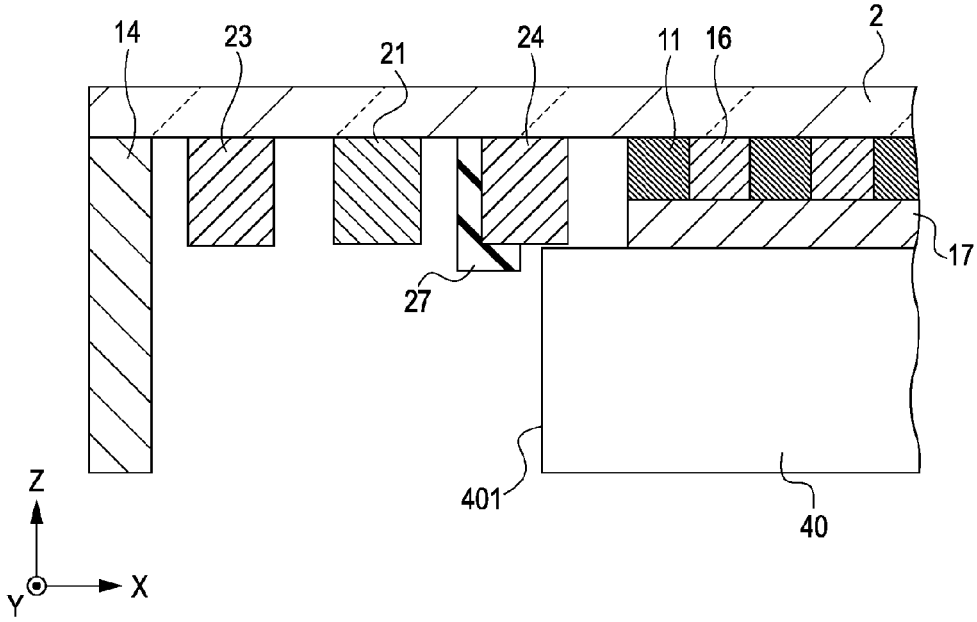
FIG. 5A and FIG. 5B are partially enlarged views that illustrate an image display apparatus according to Example 3 and Example 4 of the present invention, respectively.

As illustrated in FIG. 5A, it is useful that the low-potential electrode 24 be covered with an insulating layer 27. With this configuration, the occurrence of discharge between the feed electrode 21 and the low-potential electrode 24 can be reliably reduced.

Figure 5B:
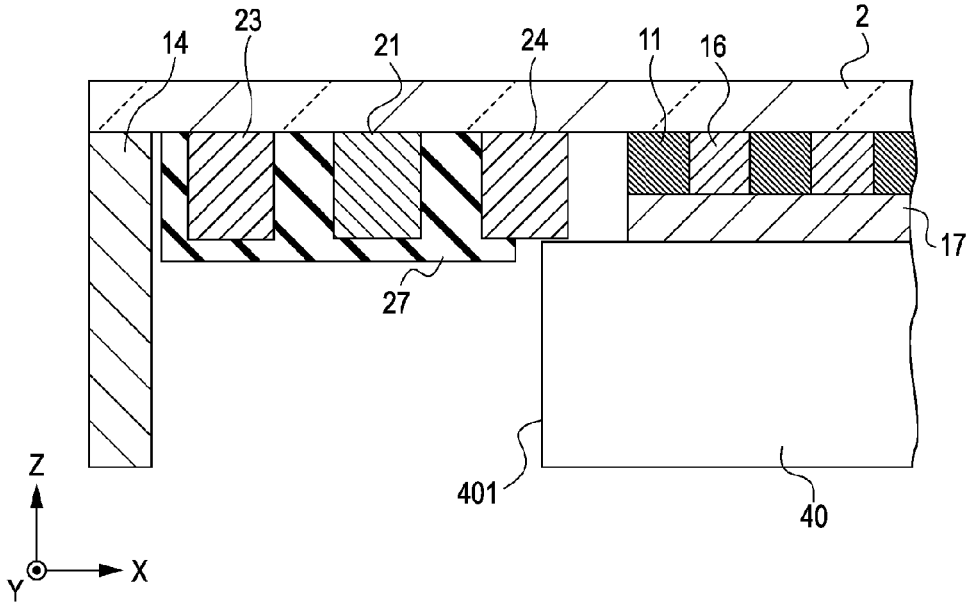

The feed electrode 21 may also be covered with an insulating layer. In this case, the occurrence of discharge in the vicinity of the feed electrode 21 can be reliably reduced. Alternatively, as illustrated in FIG. 5B, it is also useful that the feed electrode 21, the first low-potential electrode 24, and additionally, the second low-potential electrode 23 be covered with the insulating layer 27. In this case, the occurrence of discharge in the outer portions of the image display apparatus 1, including the side wall 14, can be reliably reduced.

EXAMPLES

Example 1

Example 1 of the present invention is described below. The rear plate and the general configuration of the image display apparatus have been described in the above-described embodiment. Only features of the present example are described below. FIG. 6A illustrates the face plate according to the present example seen from the rear plate side.

A high strain point glass was used in the face plate 2. The light-shielding member 11 made of carbon black and the light-emitting members 16 composed of red, green, and blue fluorescent members were formed on the surface of the face plate 2. The conductive member 171 made of aluminum was formed on each of the light-emitting members 16. The resistor 172 made of ruthenium oxide was formed on the light-shielding member 11 so as to connect adjacent conductive members 171. In such a way, the resistive anode 17 including the conductive members 171 and the resistor 172 was formed. The resistance of the resistor 172 was approximately 200 kΩ. The feed electrode 21 made of silver was formed so as to surround the resistive anode 17, which includes the conductive members 171 and the resistor 172. The feed electrode 21 was connected to the resistor 172 through the connection resistor 25. The first low-potential electrode 24 made of carbon black was formed between the feed electrode 21 and the resistive anode 17. The second low-potential electrode 23 made of carbon black was formed outside the feed electrode 21.

The plate-like spacer 40 was arranged between the face plate 2 formed in the above-described way and the rear plate 3 described in the previously described embodiment so as to lie across the resistive anode 17. In this way, the above-described image display apparatus was formed. At this time, as illustrated in FIG. 2, sufficient alignment was performed such that the longitudinal-direction ends of the plate-like spacer 40 overlapped the respective first low-potential electrodes 24. As the plate-like spacer 40, a high strain point glass covered with a semiconductor film made of a nitride of tungsten and germanium was used. An image was displayed on the image display apparatus formed in the above-described way by application of −10 V to the scanning wiring and +10 V to the information wiring and application of 12 kV from the power supply 26 to the resistive anode 17 through the feed electrode 21. GND (ground) potential was applied to the first low-potential electrode 24 and the second low-potential electrode 23.

After the image was displayed for over 10,000 hours continuously, no discharge was recognized in the image display apparatus.

The luminance in the central portion of the image display apparatus was decreased by only approximately 1.2% with respect to the luminance in the outer portions.

In contrast, when a face plate that feeds the resistive anode from only a single side without use of a feed electrode surrounding the resistive anode was used, the luminance in the central portion of the image display apparatus was decreased by approximately 5% with respect to the luminance in the outer portions, so no satisfactory displayed image was obtainable. Even with a face plate that uses a feed electrode surrounding the resistive anode, when the plate-like spacer also lay across the feed electrode 21, discharge frequently occurred in the image display apparatus, so operation was not stable.

As described above, in the present example, the occurrence of discharge was reduced and luminance distribution was significantly improved without use of a complex configuration.

Example 2

Next, Example 2 of the present invention is described. The fundamental configuration is substantially the same as in Example 1. Example 2 is different from Example 1 in that a face plate illustrated in FIG. 6B is used. The present example is different from Example 1 in that the feed electrode 21 surrounds only three sides of the resistive anode 17, as illustrated in FIG. 6B.

With such a configuration, similar advantages to those in Example 1 are obtainable. Additionally, this configuration is useful in that, as compared with Example 1, accuracy in alignment of the plate-like spacer and the face plate can be relaxed.

Example 3

Next, Example 3 of the present invention is described below. The fundamental configuration is substantially the same as in Example 1. Example 3 is different from Example 1 in that the insulating layer 27 covers a portion of the low-potential electrode 24 adjacent to the feed electrode 21, as illustrated in FIG. 5A. With this configuration, the occurrence of discharge was able to be reduced more reliably than in Example 1. More specifically, a withstand voltage between the feed electrode 21 and the first low-potential electrode 24 was approximately 1.5 times increased. Even with the configuration in which the feed electrode surrounds only three sides of the resistive anode, as in Example 2, it is useful that the portion of the low-potential electrode 24 adjacent to the feed electrode 21 be covered with an insulating layer. Even in this case, the occurrence of discharge can be reduced more reliably than in Example 2.

Example 4

Next, Example 4 of the present invention is described below. The fundamental configuration is substantially the same as in Example 3. Example 4 is different from Example 3 in that the insulating layer 27 covers from a portion of the low-potential electrode 24 adjacent to the feed electrode 21 to the feed electrode 21 to the second low-potential electrode 23, as illustrated in FIG. 5B. With this configuration, the occurrence of discharge between the second low-potential electrode 23 and the side wall 14 can also be reliably reduced. Accordingly, Example 4 can reduce the occurrence of discharge more reliably than Example 3.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-262994 filed Oct. 9, 2008, which is hereby incorporated by reference herein in its entirety.

What is claimed is:

1. An image display apparatus comprising:

a rear plate including an electron-emitting device;

a face plate including a resistive anode and a feed electrode, the feed electrode being disposed outside of the resistive anode so as to surround the resistive anode and connect the resistive anode and a power supply, the face plate facing the rear plate such that the resistive anode faces the electron-emitting device, a resistance of the resistive anode being greater than a resistance of the feed electrode; and a plate-like spacer disposed between the rear plate and the face plate, the plate-like spacer having a longitudinal-direction end disposed outside of the resistive anode so as to lie across the resistive anode, wherein the face plate further includes a low-potential electrode set at a lower potential than that of the resistive anode, the low-potential electrode being disposed between the resistive anode and the feed electrode, and the longitudinal-direction end of the plate-like spacer being disposed between the resistive anode and the feed electrode so as to overlap the low-potential electrode.

2. The image display apparatus according to claim 1, wherein the low-potential electrode is covered with an insulating layer.

3. The image display apparatus according to claim 1, wherein the feed electrode is covered with an insulating layer.

4. The image display apparatus according to claim 1, wherein the resistive anode includes a plurality of conductive members arranged in a matrix form and a resistor connecting the plurality of conductive members.

5. The image display apparatus according to claim 1, wherein the face plate further includes another low-potential electrode set at a lower potential than that of the resistive anode and disposed outside of the feed electrode so as to surround the feed electrode.

6. The image display apparatus according to claim 1, wherein the resistance of the resistive anode per unit length is greater than the resistance of the feed electrode per unit length by a factor of at least 1000.

* * * * *